US007150512B2

(12) United States Patent
Levin et al.

(10) Patent No.: US 7,150,512 B2
(45) Date of Patent: Dec. 19, 2006

(54) CLEANING SYSTEM FOR A CONTINUOUS INK JET PRINTER

(75) Inventors: Alex Levin, Glenview, IL (US); Pietro Lostumbo, Bloomingdale, IL (US)

(73) Assignee: Videojet Technologies Inc., Wood Dale, IL (US)

( * ) Notice: Subject to any disclaimer, the term of this patent is extended or adjusted under 35 U.S.C. 154(b) by 286 days.

(21) Appl. No.: 10/871,642

(22) Filed: Jun. 17, 2004

(65) Prior Publication Data

US 2005/0206673 A1 Sep. 22, 2005

Related U.S. Application Data

(63) Continuation-in-part of application No. 10/802,256, filed on Mar. 17, 2004.

(51) Int. Cl.
*B41J 2/165* (2006.01)

(52) U.S. Cl. ..... 347/22; 347/28

(58) Field of Classification Search ..... 347/22, 347/28, 34, 35, 36, 84–86; 400/701; 239/112; 118/17; 134/22.11, 104.1, 169 R, 184, 193
See application file for complete search history.

(56) References Cited

U.S. PATENT DOCUMENTS

| | | | | |
|---|---|---|---|---|
| 4,528,996 | A | 7/1985 | Jones | 347/28 |
| 4,563,688 | A | 1/1986 | Braun | 347/27 |
| 5,557,306 | A | 9/1996 | Fukushima et al. | 347/33 |
| 5,581,282 | A | 12/1996 | Okamura | 347/33 |
| 5,598,197 | A | 1/1997 | Zaba | 347/22 |
| 5,877,788 | A | 3/1999 | Haan et al. | 238/81 |
| 6,145,952 | A | 11/2000 | Sharma et al. | 347/22 |
| 6,158,839 | A | 12/2000 | Fukushima et al. | 347/33 |
| 6,254,216 | B1 | 7/2001 | Arway et al. | 347/28 |
| 6,273,103 | B1 * | 8/2001 | Enz et al. | 347/28 |
| 6,347,858 | B1 | 2/2002 | Faisst, Jr. et al. | 347/22 |
| 6,406,122 | B1 | 6/2002 | Sharma et al. | 347/28 |
| 6,435,647 | B1 | 8/2002 | Faisst, Jr. et al. | 347/28 |

(Continued)

FOREIGN PATENT DOCUMENTS

EP 1 170 130 1/2002

(Continued)

OTHER PUBLICATIONS

"Videojet *Excel* Series Auto Flush Addendum", PIN 365322-01, Rev. CC 04/02.

(Continued)

*Primary Examiner*—Juanita D. Stephens
(74) *Attorney, Agent, or Firm*—McAndrews, Held & Malloy, Ltd.

(57) ABSTRACT

A cleaning system for a continuous ink jet printer includes a first solvent supply conduit connected to a solvent source for conveying solvent through a supply opening and onto the front face of the print head. A second solvent supply conduit is connected to the solvent source for conveying solvent through a supply opening and onto a surface of the catcher. The solvent that is supplied to the print head and the catcher is removed under vacuum and returned to the ink supply system. The cleaning system may include an orifice unclogging mechanism that causes said solvent disposed on said front face to flow into said orifice in the reverse of the direction ink flows through said orifice for printing. The cleaning system may also include a piezoelectric element for generating a stress wave in the print head during cleaning. The piezoelectric element may comprise a piezoelectric oscillator that is also used during printing to creates perturbations in the ink flow at the nozzle so as to generate a stream of spaced drops from the nozzle.

22 Claims, 3 Drawing Sheets

U.S. PATENT DOCUMENTS

| | | | | |
|---|---|---|---|---|
| 6,478,402 | B1 | 11/2002 | Greive | 347/30 |
| 6,497,472 | B1 | 12/2002 | Sharma et al. | 347/28 |
| 6,511,151 | B1 | 1/2003 | Griffin et al. | 347/28 |
| 6,523,930 | B1 | 2/2003 | Griffin et al. | 347/28 |
| 6,572,215 | B1 | 6/2003 | Sharma | 347/28 |
| 6,575,556 | B1 * | 6/2003 | Eremity et al. | 347/28 |
| 6,595,617 | B1 | 7/2003 | Sharma et al. | 347/28 |
| 2001/0043250 | A1 | 11/2001 | Faisst, Jr. et al. | 347/22 |
| 2002/0075350 | A1 | 6/2002 | Sawicki | 347/33 |
| 2002/0085058 | A1 | 7/2002 | Griffin et al. | 347/28 |
| 2002/0122090 | A1 | 9/2002 | Sharma et al. | 347/28 |
| 2002/0126174 | A1 | 9/2002 | Sharma et al. | 347/28 |
| 2002/0186270 | A1 | 12/2002 | Sharma | 347/28 |

FOREIGN PATENT DOCUMENTS

| | | |
|---|---|---|
| WO | WO 93/17867 | 9/1993 |
| WO | WO 99/62717 | 12/1993 |
| WO | WO 98/06583 | 2/1998 |

OTHER PUBLICATIONS

Aug. 16, 2005 International Search Report and Written Opinion for PCT/EP2005/002750.

* cited by examiner

CLEANING SYSTEM FOR A CONTINUOUS INK JET PRINTER

RELATED APPLICATIONS

This application is a continuation-in-part of application Ser. No. 10/802,256, filed Mar. 17, 2004 and entitled "Ink Jet Print Head Cleaning System," the entire disclosure of which is hereby incorporated by reference.

BACKGROUND OF THE INVENTION

Embodiments of the present invention generally relate to a print head for an ink jet printer, and more particularly to an ink jet printer having a system for cleaning the nozzle and the catcher.

Conventional continuous ink jet printers supply electrically conductive ink under pressure to a drop generator, which has an orifice or orifices (nozzles) that are typically arranged in a linear array. The ink discharges from each orifice in the form of a filament, which subsequently breaks up into a droplet stream. Individual droplets in the stream are selectively charged in the region of the break off from the filament, and these charged drops are then deflected as desired by an electrostatic field. The deflected drops may proceed to a print receiving medium, whereas undeflected drops are caught in a gutter or catcher and recirculated.

After the printer is shut down for a period of time, ink around the orifices dries up, often partially blocking, and sometimes completely clogging, the outer openings to the orifices. Furthermore, during a long shut down period, such as an entire day or weekend, the dried ink may form a block within the orifice or passages attached to the orifice, depending on the type of ink.

Typically, print head cleaning systems and methods are limited to the nozzle, or drop generator. However, ink deposits and residue also accumulate around the catcher, for example. Ink droplets often settle on and within the catcher. As ink deposits and residue accumulate on these components, printing quality suffers due to the clogging of the components and conduits therebetween, or due to interference between built-up residue and ink droplets. That is, the recycling rate of ink and other fluids through these components decreases as the accumulation of deposits and residue increases. Often, the ink jet printer is completely shut down in order for an operator to manually clean these components, thereby precluding use of the printer.

Thus, a need exists for a system and method for more effectively cleaning various components of a print head of an ink jet printer. Overall, a need exists for an efficient system and method of cleaning a print head of an ink jet printer.

BRIEF SUMMARY OF THE INVENTION

According to an embodiment of the present invention, a cleaning system is provided for a continuous ink jet printer. The printer has an ink flow system wherein ink flows from a reservoir to a print head. The ink is ejected from the print head in a series of discrete droplets directed at a substrate upon which an image is to be formed by applying droplets to the surface of the substrate. Droplets which are not to be applied to the substrate are collected in a catcher and recycled via a return line to the ink flow system for reuse. The print head includes a front face and at least one orifice extending through the front face. The cleaning system a first solvent supply conduit connected to a solvent source for conveying solvent through a supply opening and onto the front face of the print head. A second solvent supply conduit is connected to the solvent source for conveying solvent through a supply opening and onto a surface of the catcher.

The cleaning system may include an orifice unclogging mechanism that causes said solvent disposed on said front face to flow into said orifice in the reverse of the direction ink flows through said orifice for printing. According to one embodiment, the printer further includes a main conduit for supplying ink to said orifice and the orifice unclogging mechanism includes a vacuum conduit connected to the main conduit so that negative pressure may be applied to suction solvent from the front face, through the orifice and into the vacuum conduit. A check valve may be disposed in the vacuum conduit, the check valve being adapted to open to allow solvent to be suctioned through said vacuum conduit in a first direction and to close to prevent backflow through said conduit in the opposite direction. The check valve is preferably made as rubber duck-bill valve, which has been found to prevent or minimize the mini spills that occur at start up and shut down.

The cleaning system may also include a piezoelectric element for generating a stress wave in the print head during cleaning. The piezoelectric element may comprise a piezoelectric oscillator that is also used during printing to creates perturbations in the ink flow at the nozzle so as to generate a stream of spaced drops from the nozzle.

Another embodiment relates to a method of cleaning a continuous ink jet printer of the type having an ink flow system in which ink is adapted to flow from a reservoir to a print head from which the ink is ejected in a series of discrete droplets directed at a substrate upon which an image is to be formed by applying droplets to the surface of the substrate and in which droplets which are not to be applied to the substrate are collected in a catcher and recycled via a return line to the ink flow system for reuse, the print head having front face and at least one orifice extending through the front face, the orifice defining a nozzle for ejecting the ink. The cleaning method comprises flowing solvent through a solvent supply conduit to a front face of the print head such that the solvent moves along the front face adjacent to the orifice, suctioning the solvent from the front face and into a drain conduit to remove said solvent from the front face of the print head, flowing solvent directly onto a surface of the catcher, and suctioning the solvent from the catcher through the return line. The method may also include the step of flowing the solvent disposed on the front face of the print head into the orifice in the reverse of the direction ink flows through the orifice for printing. The method may also include generating a stress wave in the print head during cleaning so as to loosen dried ink in the print head.

Another embodiment relates to a method of cleaning a continuous ink jet printer of the type having print head with a front face presenting an orifice for emitting a droplet stream toward a substrate during a printing cycle. The cleaning method comprising the steps of supplying solvent to a front face of the print head such that the solvent moves along said front face adjacent to said orifice; and generating a stress wave in the print head during the cleaning process so as to loosen dried ink in the print head.

Another embodiment relates to a cleaning system for a continuous ink jet printer having a print head including a front face and at least one orifice extending through the front face. The cleaning system comprises a conduit for supplying solvent to the front face of the print head, adjacent the orifice. A main ink conduit is provided for supplying ink to the orifice. A vacuum conduit is connected to the main conduit so that negative pressure may be applied to suction solvent from the front face, through the orifice and into the vacuum conduit. A check valve is disposed in the vacuum conduit. The check valve is adapted to open to allow solvent to be suctioned through the vacuum conduit in a first direction and to close to prevent backflow through the conduit in the opposite direction.

Figure 1:
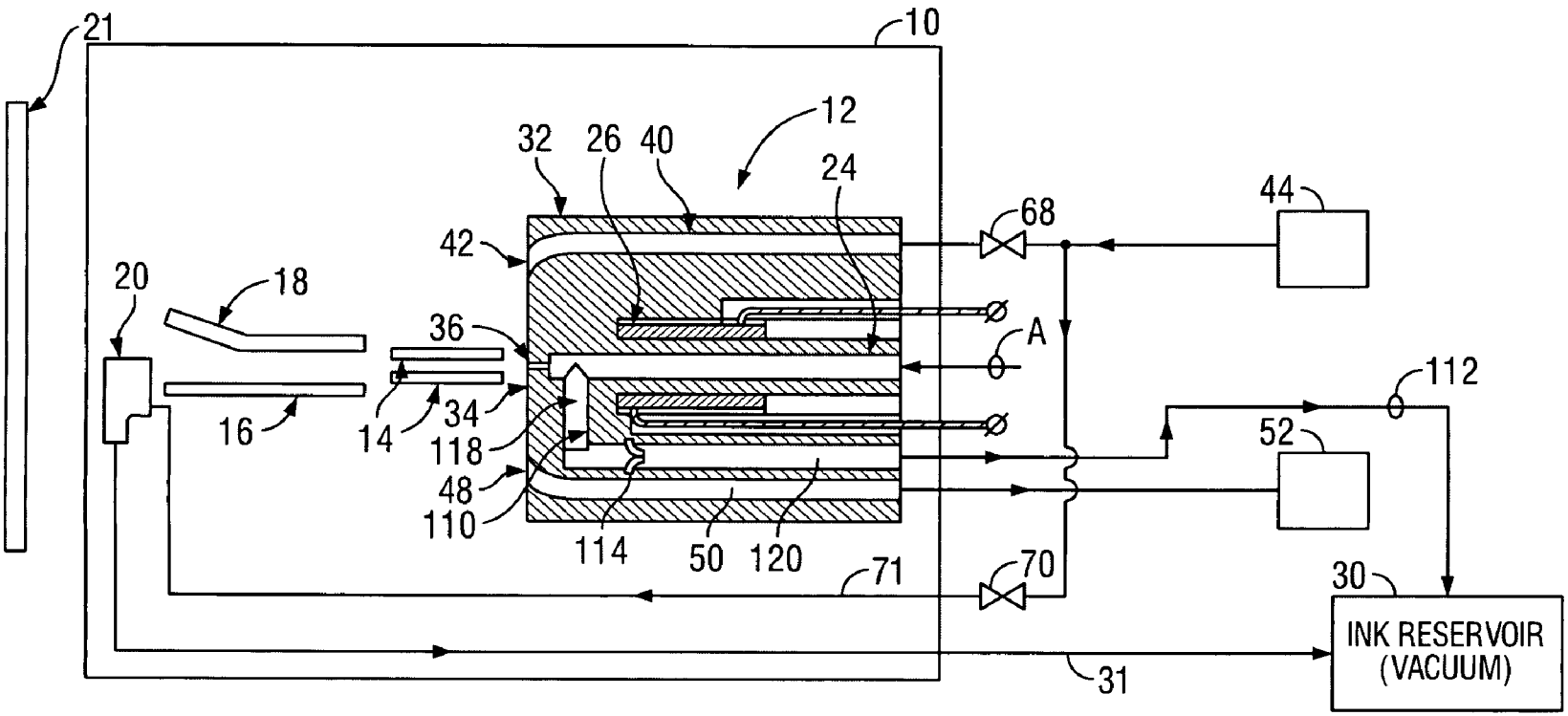
FIG. 1 is a simplified schematic side view of components of an ink jet printer of an embodiment of the present invention with the drop generator shown in the cross section.

The foregoing summary, as well as the following detailed description of certain embodiments of the present invention, will be better understood when read in conjunction with the appended drawings. For the purpose of illustrating the invention, there is shown in the drawings, certain embodiments. It should be understood, however, that the present invention is not limited to the arrangements and instrumentalities shown in the attached drawings.

DETAILED DESCRIPTION OF THE INVENTION

FIG. 1 illustrates a printer that incorporates a cleaning system according to an embodiment of the present invention. The printer includes print head 10 having a drop generator 12, a charge electrode 14, a ground plate 16, a high voltage deflection plate 18, and a catcher 20. The charge electrode 14, the ground plate 16, the high voltage deflection plate 18, and the catcher 20 are positioned between the drop generator 12 and a substrate 21, which is remotely located from the print head window (not shown). During printing, the drop generator 12 receives ink from a main conduit 24 as shown and described in U.S. Pat. No. 6,575,556, entitled "Self-Cleaning Print Head for Ink Jet Printer," which is hereby incorporated by reference in its entirety. A piezoelectric cylinder 26 is bonded around the main conduit 24 in order to impart vibrational energy of a selected frequency to the ink received by the drop generator 12. A droplet stream is thus created and selectively charged by the charge electrode 14. An electrostatic field formed between the deflection plate 18 and the ground plate 16 deflects the charged drops of ink over the catcher 20 and onto the substrate 21. Uncharged drops that pass between the deflection plate 18 and ground plate 16 are not deflected and pass directly into the catcher 20, which is vacuum assisted to recirculate the ink back into ink reservoir 30 via a return line 31.

The drop generator 12 has an outer housing or body 32 with a front face 34. The front face 34 may include a solvent-wettable, generally planar surface as described in the '556 patent. The surface is solvent-wettable in order to spread out the solvent to maintain the solvent as a thin film when the viscosity of the solvent is low. The solvent-wettable material can be PEEK (polyetheretherketone), for example. For purposes of this application, a solvent-wettable surface is one on which a solvent tends to spread out, whereas a non-solvent wettable surface is one on which a solvent tends to bead up.

An orifice 36 extends through the front face 34 at an end of the main conduit 24 for emitting the ink stream. The drop generator 12 also has a solvent supply conduit 40 with one end terminating at a supply opening 42 on the front face 34 near the orifice 36. The opposite end of the solvent supply conduit 40 is connected to a solvent supply system 44. As described in the '556 patent, a flow restrictor (not shown) with a narrow slit or hole may be positioned within the solvent supply conduit 40 for influencing the pressurized solvent to form a thin film at the supply opening 42 by reducing the pressure on the solvent as it flows from supply opening 42.

On the opposite side of the orifice 36 from the position of the solvent supply opening 42, a drain opening 48 communicates with a drain conduit 50 connected to a solvent return system 52. Drain opening 48 may be larger than supply opening 42. The drain conduit 50 under vacuum pressure (for example, approximately 10" mercury). The solvent 54 flows out of the supply opening 40, over orifice 36 and into drain opening 48, is explained in the '556 patent.

Figure 2:
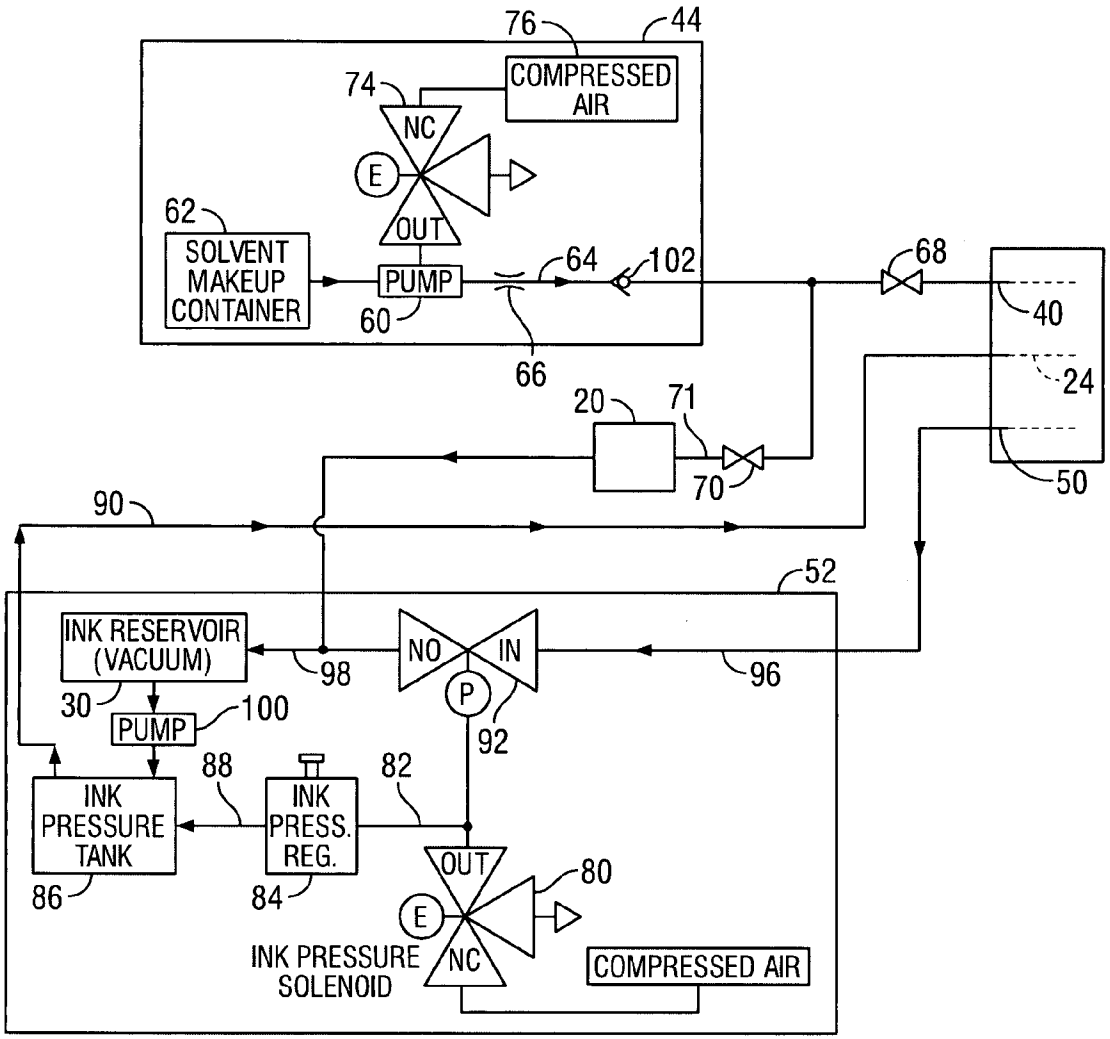
FIG. 2 is a diagram of the system for circulating the solvent in the ink jet printer in accordance with an embodiment of the present invention.

Referring to FIG. 2, the solvent supply system 44 includes a pump 60 that runs the cleaning solution or solvent from a solvent makeup container 62, through a conduit 64 and to the supply conduit at the drop generator 12. The conduit 64 is shown with an alternative flow restrictor 66 connected in the solvent supply system 44. The alternative flow restrictor 66 can be used instead of the flow restrictor disposed within the solvent supply conduit 40 in the drop generator 12. The flow restrictor 66 is provided to regulate the flow of solvent through adjustment of the solvent supply pressure. A valve 68, such as a solenoid actuated valve, is interconnected between the conduit 64 and the supply conduit 40 for controlling the flow of solvent to the drop generator 12. Similarly, a valve 70, such as a solenoid activated valve, is interconnected between the conduit 64 and the catcher supply line 71 for controlling the flow of solvent from the solvent supply system 40 to the catcher 20. Alternatively, a single valve could be used to regulate the flow of solvent to both the catcher 20 and drop generator 12.

A valve 74 is provided in the solvent supply system 44 for providing compressed air 76 to the pump 60. The pump 60 uses the compressed air 76 to force or push the solvent to the print head 12 and the catcher 20. It will be appreciated, however, that other pumping systems that do not use compressed air could be used instead.

The solvent return system 52 has an ink pressure solenoid-activated valve 80 (hereafter, referred to merely as ink pressure solenoid 80) connected through conduit 82 to an ink pressure regulator 84, which in turn is connected to an ink pressure tank 86 though conduit 88. Ink pressure tank 86 is further connected to main conduit 24 through conduit 90. Solenoid 80 also connects with a valve 92 through conduit 94. In one direction, the valve 92 also connects to a conduit 96 that links to drain conduit 50 at the drop generator 12. In another direction, the valve 92 connects to a conduit 98 that opens to the ink reservoir 30.

Referring to FIGS. 1 and 2, when the ink jet printer is running, ink is pumped from the reservoir 30 by transfer pump 100, pressurized in ink pressure tank 86 and then supplied to main conduit 24 via conduit 90 for printing. The ink is pressurized by energizing the ink pressure solenoid 80, which allows compressed air into conduit 82, ink pressure regulator 84, conduit 88 and the ink pressure tank 86. Compressed air in the conduit 94 closes air operated valve 92, which closes off conduit 96 from the ink reservoir vacuum conduit 96.

For the cleaning process (preferably before start-up, after shut down and/or during maintenance operations), the ink supplied to the main conduit 24 is shut off by de-energizing the ink pressure solenoid 80 to de-pressurize the ink pressure tank 86, which turns off the ink stream. De-energizing solenoid 80 also allows valve 92 to open and connects conduit 50 to the ink reservoir 30 (under vacuum) through conduit 96. This permits used solvent and residue ink from the front face 34 of the drop generator 12 to be placed in the ink reservoir 30. Similarly, the solvent that is supplied to the catcher 20 during cleaning is suctioned through the return line 31 and into the reservoir 30. As the total amount of solvent added to the ink system during cleaning is relatively small, ink composition control is substantially unaffected by the cleaning operation.

Shortly after ink pressure solenoid 80 is de-energized, valve 74 is energized. This allows compressed air 76 to flow through conduit 78 to air operated pump 60. The valves 68, 70 are selectively opened to regulate the flow of solvent from the pump 60 to the drop generator 12 and the catcher 20. The conduit 64 can include a check valve 102 to prevent reverse or back flow. From conduit 64, the solvent supply system 44 supplies solvent under pressure through solvent supply conduit 40 in the drop generator 12 and onto front face 34. On the front face 34, the solvent spreads over an area adjacent orifice 36. The solvent flow may be uniform or pulsating. The type of solvent flow will depend on its supply pressure mechanism. For example, different pump restrictions or pump control systems can provide either uniform or pulsed fluid pressures, thus providing either uniform or pulsating solvent flow.

While the flow of solvent dissolves residue, ink accumulations or any other particles on the front face 34 and in the orifice 36, the solvent is sucked into drain opening 48 and follows drain conduit 50 back to the solvent return system 52. As described in the '556 patent, appropriate negative pressure or vacuum from drain conduit 50 sustains the solvent flow on the front face 14 in any print head spatial orientation, independent of gravity, and prevents solvent from dropping off the print head 12. After a predetermined cleaning time, valve 74 is de-energized to stop the flow of compressed air 76 and turn off pump 60, thereby stopping the flow of solvent.

Referring again to FIG. 1, the drop generator 12 may also provide with a vacuum conduit 110 that is connected at one end to the main conduit 24 just behind the orifice 36. The other end of the vacuum conduit 110 is connected via conduit 112 to the ink reservoir 30 under vacuum. During the cleaning process, when conduit 110 is applying negative pressure or vacuum, part of the solvent flowing over the orifice 36 is drawn through the orifice 36 in the reverse of the direction of ink flow during printing. The solvent is then drawn into main conduit 24 and vacuum conduit 110, and finally returned to the ink reservoir 30 via conduit 112. This portion of solvent flow effectively cleans the interior of the orifice 36 as well as adjacent parts of the main conduit 24. The remainder of the solvent on the front face 34 flows as described above into drain conduit 50. Pulsating flow may be used to aid in dissolving residue in the interior of orifice 36.

An elastomeric check valve 114 is provided in the conduit 110. The valve 114 opens to allow the flow of solvent in a direction from the orifice 36 to the reservoir 30 and closes to prevent fluid flow in the reverse direction. The check valve is preferably in the form of a duck bill valve and may be made of an elastomeric material such as rubber. In addition to preventing back flow at the end of the cleaning process, the valve 114 also provides dampening to the ink flow during start up and shut down. The dampening provided by the valve 114 is beneficial for reducing ink splatter during start up and shut down. Specifically, at start up there is a quick increase in pressure, which causes a jittering flow effect. This can cause the ink to splatter during start up. The ink splatters settle on the parts of the print head, solidify, and accumulate over time. These accumulations of ink can obstruct or interfere with the ink jet. Similarly, ink splatter can occur during shut down because the ink pressure does not immediately drop to zero. As the ink jet looses pressure it can break down, resulting in ink splatters. The elastomeric duck bill valve dampens the ink flow during start up and shut down, thereby reducing the tendency for ink splatter to occur.

During the cleaning procedure described above the flow of solvent output from supply opening 42 is divided between the conduits 50, 110. The ratio of flow through conduits 50, 110 depends on the amount of vacuum in those conduits and on the geometric dimensions of those conduits. For example, the relatively small diameter of orifice 36, which may be on the order of 66 micron, causes a comparatively small amount of flow to be drawn into conduit 110; a majority of the solvent flows across the face 34, around the orifice 36 and into drain opening 48. As will be appreciated, the flow ratio can be adjusted by varying the amount of vacuum in one or both of the conduits 50, 110. The ratio can be optimized by changing the vacuum amounts in one or in both of those lines.

According to certain aspects of one embodiment, the piezoelectric element 26 is operated during the cleaning process. The piezoelectric element 26 generates stress waves, which assist the cleaning process. The stress waves loosen particles, facilitating their removal by the makeup flow. The voltage and frequency applied to the piezoelectric element 26 can be the same as those used during printing. For example, 30–75 V and 66 KHz. Alternatively, a frequency sweep 30–90 KHz might be applied for more efficient cleaning.

Figure 3:
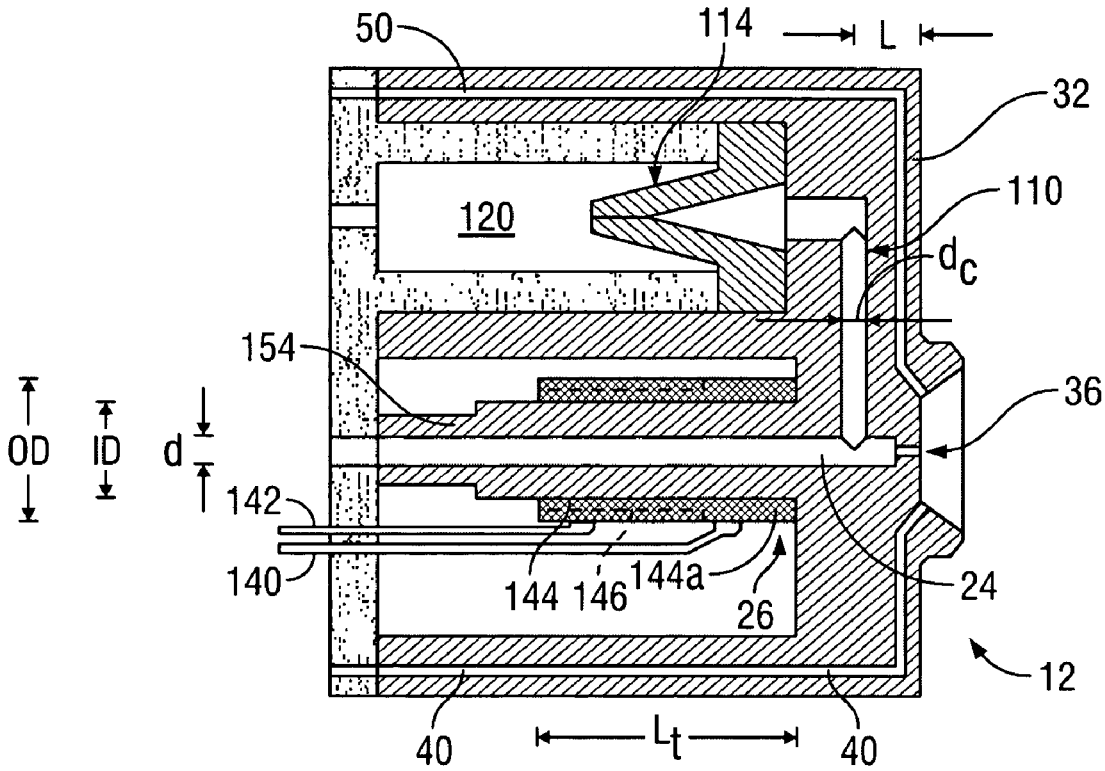
FIG. 3 is a cross-sectional view of a drop generator in accordance with an embodiment of the present invention.

Referring to FIG. 3, the design and location of the piezoelectric element in the nozzle, contribute to creating effective stress waves. According to one presently preferred embodiment, the ratio between the parameters of the piezoelectric elements 26 are $L_t$:OD:ID=2.0:1.4:1.

Where:

$L_t$ is piezoelectric tube length

OD is tube outside diameter

ID is tube inside diameter

In order to generate desirable stress waves, the piezoelectric element 26, as well as the feature it is bonded to, should have cylindrical forms. The piezoelectric element 26 is a ceramic tube plated with metal wherein, the outer portion has a negative charge and inner portion has a positive charge. Positive and negative lead wires 140, 142 are connected to the positively and negatively charged portions 144, 146 of the piezoelectric element 26. It is difficult to attach the positive lead wire 142 to the positively charged inner portion without breaking cylindrical form of the piezo tube or the feature it is attached to. Therefore, the positive portion 144 is expanded so that it covers a small portion of the outside of the tube (designated as 144*a*) in order to provide a connection point for the positive lead wire 140. This design allows both lead wires 140, 142 to be attached to the outside of the piezoelectric element 26. Preferably the piezoelectric element 26 is constructed such that the negative portion of the outer diameter area remains at least 66% of the entire outer diameter area.

The distance from the piezoelectric element 26 to the orifice preferably equals less than 1.1 OD. Moreover, the conductive portion/end of the OD is preferably directed towards the orifice 36. These parameters have been found to provide effective cleaning.

Clean start up is also provided by certain sequencing and timing. Specifically after ink is allowed into the drop generator 12 via the conduit 24, the cavity 120 remains connected with the vacuum for a period of time necessary to fill the cavity 120 with ink. This ensures that no air is left inside the print head 12. Eliminating air from the print head is beneficial because such air would otherwise be drawn into the ink flow during printing, thereby creating voids in the flow and interrupting normal printer operation.

The design of the drop generator 12 also contributes to clean printer start up. Specifically, conduit 24, which delivers ink to the orifice 36, is straight, which as been found to be effective in reducing ink splatters during start up and shut down. Bypass conduit 110 includes a first portion 118, which connects to main conduit 24 at a right angle for ease of manufacture. According to one presently preferred embodiment, the conduits 24, 118 were configured as:

$$L/d=2.3$$

$$d=d_c$$

Where:

L is the distance from the orifice to the interconnection between conduits 24 and 110;

d is the diameter of the conduit 24; and and $d_c$ is the diameter of conduit 110.

This ratio has been found to be effective for both ink jetting and cleaning.

As was discussed above, backflow from the cavity 120 is prevented by the check valve 114. The elastomeric valve 114 accommodates pressure fluctuations, and prevents ink splatters during shut down and start up. Preventing even small splatters is important because such splatters settle on ground or deflection plates. Over time such ink splatter builds up and can obstruct ink jet and therefore interrupt normal printing process.

As is shown in FIG. 3, the body 32 of the drop generator may comprise mating first and second portions 150, 152. The tubular piezoelectric element 26 is mounted over a tubular member 154 formed on the interior of the first portion 152. The tubular member 154 defines the main conduit 24. The check valve 114 mounted within the compartment 120 and is sandwiched between the first and second portions 150, 152.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

The invention claimed is:

1. A cleaning system for a continuous ink jet printer of the type having an ink flow system in which ink is adapted to flow from a reservoir to a print head from which the ink is ejected in a series of discrete droplets directed at a substrate upon which an image is to be formed by applying droplets to the surface of the substrate and in which droplets which are not to be applied to the substrate are collected in a catcher and recycled via a return line to the ink flow system for reuse, the print head including a front face and at least one orifice extending through the front face, the orifice defining a nozzle for ejecting the ink, the cleaning system comprising:

a source of solvent;

a first solvent supply conduit connected to the solvent source for conveying solvent through a supply opening and onto the front face of the print head; and a second solvent supply conduit connected to the solvent source for conveying solvent through a supply opening and onto a surface of the catcher.

2. A cleaning system as set forth in claim 1, further comprising an orifice unclogging mechanism that causes said solvent disposed on said front face to flow into said orifice in the reverse of the direction ink flows through said orifice for printing.

3. A cleaning system as set forth in claim 2, wherein the printer further comprise a main conduit for supplying ink to said orifice, and wherein the orifice unclogging mechanism further includes a vacuum conduit connected to the main conduit so that negative pressure may be applied to suction solvent from the front face, through the orifice and into the vacuum conduit.

4. A cleaning system as set forth in claim 3, further comprising a check valve disposed in said vacuum conduit, the check valve being adapted to open to allow solvent to be suctioned through said vacuum conduit in a first direction and to close to prevent backflow through said conduit in the opposite direction.

5. A cleaning system as set forth in claim 4, wherein the check valve comprises an elastomeric member.

6. A cleaning system as set forth in claim 1, further comprising a piezoelectric element for generating a stress wave in the print head during cleaning.

7. A cleaning system as set forth in claim 6, wherein the piezoelectric element comprises a piezoelectric oscillator that is also used during printing to creates perturbations in the ink flow at the nozzle so as to generate a stream of spaced drops from the nozzle.

8. A cleaning systems as set forth in claim 1, further comprising a drain conduit for suctioning solvent from the front face of the print head.

9. A method of cleaning a continuous ink jet printer of the type having an ink flow system in which ink is adapted to flow from a reservoir to a print head from which the ink is ejected in a series of discrete droplets directed at a substrate upon which an image is to be formed by applying droplets to the surface of the substrate and in which droplets which are not to be applied to the substrate are collected in a catcher and recycled via a return line to the ink flow system for reuse, the print head having front face and at least one orifice extending through the front face, the cleaning method comprising the steps of:

flowing solvent through a first solvent supply conduit to a front face of the print head such that the solvent moves along said front face adjacent to said orifice;

suctioning the solvent from the front face and into a drain conduit to remove said solvent from the front face of the print head;

flowing solvent through a second solvent supply conduit directly onto a surface of the catcher; and suctioning the solvent from the catcher through the return line.

10. The method of claim 9, further comprising the step of flowing the solvent disposed on the front face of the print head into the orifice in the reverse of the direction ink flows through the orifice for printing.

11. The method of claim 9, further comprising generating a stress wave in the print head during the cleaning process.

12. The method of claim 9, further comprising operating a piezoelectric element of the print head during cleaning.

13. A method of cleaning a continuous ink jet printer of the type having print head with a front face presenting an orifice for emitting a droplet stream toward a substrate during a printing cycle, the cleaning method comprising the steps of:

supplying solvent to a front face of the print head through a first solvent supply conduit such that the solvent moves along said front face adjacent to said orifice;

flowing solvent directly onto a surface of the catcher through a second solvent supply conduit; and generating a stress wave in the print head during the cleaning process so as to loosen dried ink in the print head.

14. The method of claim 13, wherein the step of generating a stress wave comprising operating a piezoelectric element of the print head during cleaning.

15. The method of claim 13, further comprising suctioning the solvent from the catcher through a return line.

16. The method of claim 13, further comprising the step of flowing the solvent disposed on the front face of the print head into the orifice in the reverse of the direction ink flows through the orifice for printing.

17. A self-cleaning print head for an ink jet printer that directs ink to a substrate to be marked, the print head comprising:

a drop generator having front face including an orifice for emitting a droplet stream toward a substrate during a printing cycle;

a charge electrode for selectively charging ink droplets in said droplet stream during the printing cycle;

a deflection plate and a ground plate having a channel formed therein, wherein an electrostatic field is formed between said deflection plate and said ground plate to deflect charged droplets of ink toward the substrate during the printing cycle;

a catcher for receiving uncharged droplets of ink during the printing cycle; and a solvent supply system that supplies solvent directly to the front face of the drop generator through a first solvent supply conduit and to the catcher through a second solvent supply conduit during a cleaning cycle.

18. A self-cleaning print head for an ink jet printer that directs ink to a substrate to be marked, the print head comprising:

a drop generator having an orifice for emitting a droplet stream toward a substrate during a printing cycle, the drop generator including a piezoelectric element that is operable during a cleaning cycle for generating a stress wave in the drop generator and that is operable during a printing cycle to create perturbations in the ink flow at the orifice so as to generate a stream of spaced drops from the orifice;

a solvent supply system that supplies solvent to the drop generator through a first solvent supply conduit to clean at least a portion of the drop generator during the cleaning process, said solvent supply system also supplying solvent to a catcher through a second solvent supply conduit, said solvent being formulated to remove ink residue from said drop generator as said solvent flows over said drop generator.

19. A print head as set forth in claim 18, wherein said solvent supply system supplies solvent to an exterior surface of the drop generator adjacent to the orifice.

20. A print head as set forth in claim 18, wherein the print head further comprises a catcher for catching uncharged ink drops during the printing cycle and wherein the solvent supply system further supplies solvent directly to a surface of said catcher during the cleaning process.

21. A cleaning system for a continuous ink jet printer having a print head including a front face and at least one orifice extending through the front face, the cleaning system comprising:

a conduit for supplying solvent to the front face of the print head, adjacent the orifice;

a main ink conduit for supplying ink to said orifice;

a vacuum conduit connected to the main conduit so that negative pressure may be applied to suction solvent from the front face, through the orifice and into the vacuum conduit; and a check valve disposed in said vacuum conduit, the check valve being adapted to open to allow solvent to be suctioned through said vacuum conduit in a first direction and to close to prevent backflow through said conduit in the opposite direction.

22. The cleaning system of claim 21, wherein the check valve comprises an elastomeric check valve.

* * * * *